US008936496B2

(12) United States Patent
Takane et al.

(10) Patent No.: US 8,936,496 B2
(45) Date of Patent: Jan. 20, 2015

(54) CONNECTOR

(75) Inventors: Toru Takane, Kanagawa (JP); Kenichi Yamaguchi, Kanagawa (JP); Tomisaburo Yamaguchi, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/345,441

(22) PCT Filed: Sep. 10, 2012

(86) PCT No.: PCT/JP2012/073026

§ 371 (c)(1),
(2), (4) Date: Mar. 18, 2014

(87) PCT Pub. No.: WO2013/047164

PCT Pub. Date: Apr. 4, 2013

(65) Prior Publication Data

US 2014/0349526 A1 Nov. 27, 2014

(30) Foreign Application Priority Data

Sep. 26, 2011 (JP) ..... 2011-209596

(51) Int. Cl.
*H01R 13/40* (2006.01)
*H01R 13/502* (2006.01)

(52) U.S. Cl.
CPC ..... *H01R 13/502* (2013.01)
USPC ..... 439/733.1

(58) Field of Classification Search
USPC ..... 439/733.1, 886, 884, 345, 374, 439/751–752, 857
See application file for complete search history.

(56) References Cited

U.S. PATENT DOCUMENTS 6,247,976 B1 * 6/2001 Chiu ..... 439/857
6,250,966 B1 * 6/2001 Hashimoto et al. ..... 439/631

(Continued)

FOREIGN PATENT DOCUMENTS

JP 2007-173255 A 7/2007
JP 2008-146935 A 6/2008

(Continued)

OTHER PUBLICATIONS

International Search Report for PCT Patent App. No. PCT/JP2012/073026 (Nov. 27, 2012).

(Continued)

*Primary Examiner* — Jean F Duverne
(74) *Attorney, Agent, or Firm* — Cermak Nakajima & McGowan LLP; Tomoko Nakajima

(57) ABSTRACT

Provided is a connector in which a decrease in contact pressure due to the shape degradation of the pressing portions does not occur even if the operation of rotating the pressing member is repeated. Since the connector main body has, at the rear end, supporting portions that rotatably support the pressing portion, the pressing portion rotates while butting the rear ends of the movable pieces and the supporting portions so that the rear ends of the movable pieces are pushed up by the pressing portion, the butting of the pressing portion and the supporting portions is contact between synthetic-resin components, this eliminates the pressing portion being cut off due to contact with the supporting portions even if the rotation of the pressing member is repeated, and hence the shape degradation of the pressing portion can be prevented.

4 Claims, 6 Drawing Sheets

(56) References Cited

U.S. PATENT DOCUMENTS

| | | | | |
|---|---|---|---|---|
| 6,371,772 | B1 * | 4/2002 | Yoneyama et al. | 439/79 |
| 7,744,430 | B1 * | 6/2010 | Vrenna et al. | 439/733.1 |
| 7,744,431 | B2 * | 6/2010 | Trout et al. | 439/733.1 |

FOREIGN PATENT DOCUMENTS

| | | | |
|---|---|---|---|
| JP | 2008-300340 | A | 12/2008 |
| JP | 2009-277398 | A | 11/2009 |

OTHER PUBLICATIONS

Notice of Reasons for Rejection from Japanese Patent App. No. 2011-209596 (Nov. 21, 2011) with verified English language translation thereof.

* cited by examiner

CONNECTOR

This application is a national phase entry under 35 U.S.C. §371 of PCT Patent Application No. PCT/JP2012/073026, filed on Sep. 10, 2012, which claims priority under 35 U.S.C. §119 to Japanese Patent Application No. 2011-209596, filed Sep. 26, 2011, both of which are incorporated by reference.

TECHNICAL FIELD

The present invention relates to a connector for connecting, for example, a flexible printed circuit (FPC) or a flexible flat cable (FFC).

BACKGROUND ART

Known examples of this kind of connector include a synthetic-resin connector main body in which an object to be inserted, such as an FPC or an FFC (hereinafter referred to as a flexible circuit), is inserted from the front, a plurality of terminals held in the connector main body at certain intervals in the width direction, movable pieces provided at the terminals in such a manner as to extend in a front-to-back direction, and a synthetic-resin pressing member that is rotatably provided at the rear end of the connector main body and that brings the movable pieces of the individual terminals into pressure-contact with the object by rotating in a predetermined direction. When the pressing member is rotated in the predetermined direction, pressing portions provided at the pressing member push up the rear ends of the movable pieces of the individual terminals while rotating, thus displacing the front ends of the movable pieces downwards to bring the front ends of the movable pieces into contact with the upper surface of the object (for example, refer to PTL 1).

This connector has, at the rear ends of the individual terminals, extending portions extending backwards with a certain distance in the vertical direction from the movable pieces. The pressing portions rotate between the rear ends of the movable pieces and the extending portions so that the rear ends of the movable pieces are pushed up by the pressing portions.

CITATION LIST

Patent Literature

PTL 1: Japanese Unexamined Patent Application Publication No. 2007-173255

SUMMARY OF INVENTION

Technical Problem

The known connector rotates while the pressing portions keep contact with the rear ends of the movable pieces of the terminals and the extending portions. However, the extending portions are harder than the synthetic-resin pressing portions because they are integrally formed with the metal terminals, and the area of contact with the pressing portions is small because they are small in width. Thus, repeating the operation of rotating the pressing member causes scraping-off of portions of the pressing portions in contact with the extending portions. Such shape degradation causes an insufficient pushing height at the rear ends of the movable pieces with the pressing portions, thus posing the problem of decreasing the contact pressure of the movable pieces on the flexible circuit.

The present invention is made in consideration of the above problem. An object thereof is to provide a connector in which a decrease in contact pressure due to the shape degradation of the pressing portions does not occur even if the operation of rotating the pressing member is repeated.

Solution to Problem

To achieve the above object, the present invention provides a connector including a synthetic-resin connector main body into which an object to be inserted is to be inserted from the front; a plurality of terminals held in the connector main body at certain intervals in a width direction; movable pieces provided at the individual terminals in such a manner as to extend in a front-to-back direction; and a synthetic-resin pressing member rotatably provided at a rear end of the connector main body, the pressing member bringing the movable pieces of the individual terminals into pressure-contact with the object by rotating in a predetermined direction. When the pressing member is rotated in the predetermined direction, a pressing portion provided at the pressing member pushes up the rear ends of the movable pieces of the individual terminals while rotating to displace the front ends of the movable pieces downwards into contact with the upper surface of the object. The connector main body has, at the rear end, supporting portions that rotatably support the pressing portion. The pressing portion rotates while butting the rear ends of the movable pieces and the supporting portions of the connector main body so that the rear ends of the movable pieces are pushed up by the pressing portion.

Thus, since the pressing portion rotates while butting the rear ends of the movable pieces and the supporting portions of the connector main body, the rear ends of the movable pieces are pushed up by the pressing portion. Thus, the butting of the pressing portion and the supporting portions is contact between synthetic-resin components. This eliminates the pressing portion being cut off due to contact with the supporting portions even if the rotation of the pressing member is repeated.

Advantageous Effects of Invention

According to the present invention, the pressing portion is not cut off due to contact with the supporting portions even if the rotation of the pressing member is repeated, and hence the shape degradation of the pressing portion can be prevented. This allows the movable pieces pushed up by the pressing portion to be constantly kept at a sufficient height, thus effectively preventing a decrease in the contact pressure of the movable pieces on the flexible circuit.

DESCRIPTION OF EMBODIMENTS

Figure 1:
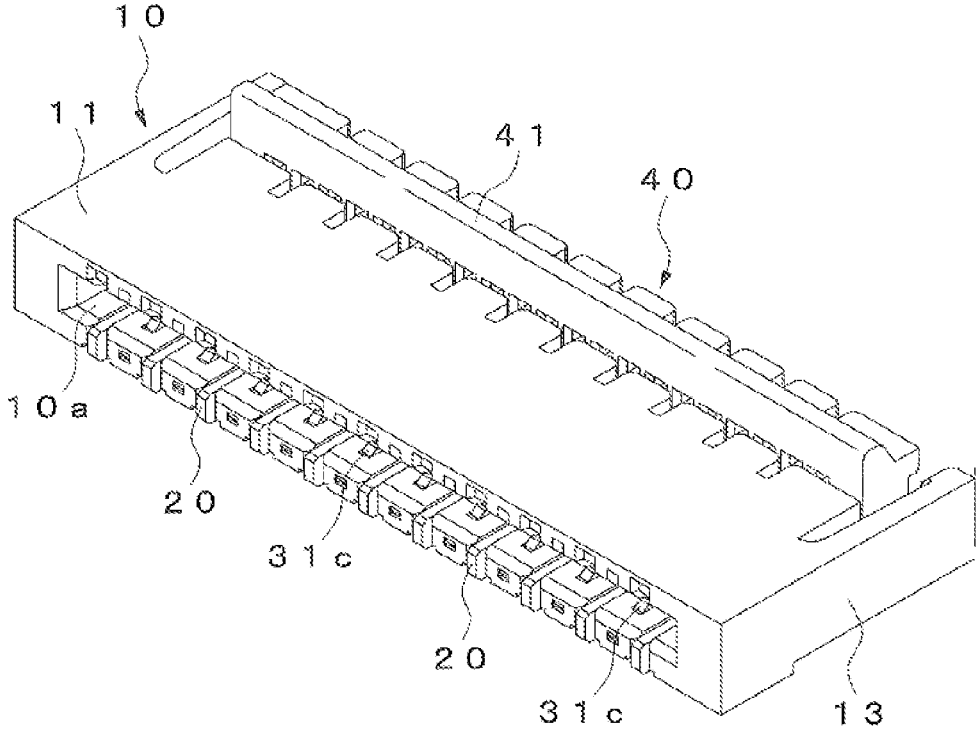
FIG. 1 is a front perspective view of a connector according to an embodiment of the present invention.
Figure 2:
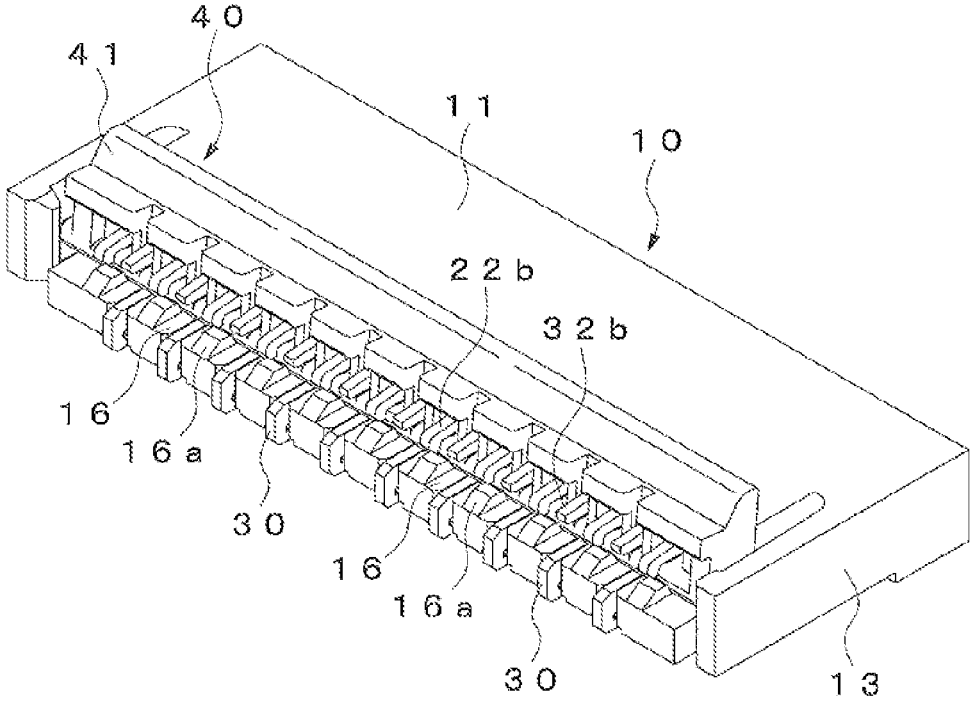
FIG. 2 is a back perspective view of the connector.
Figure 3:
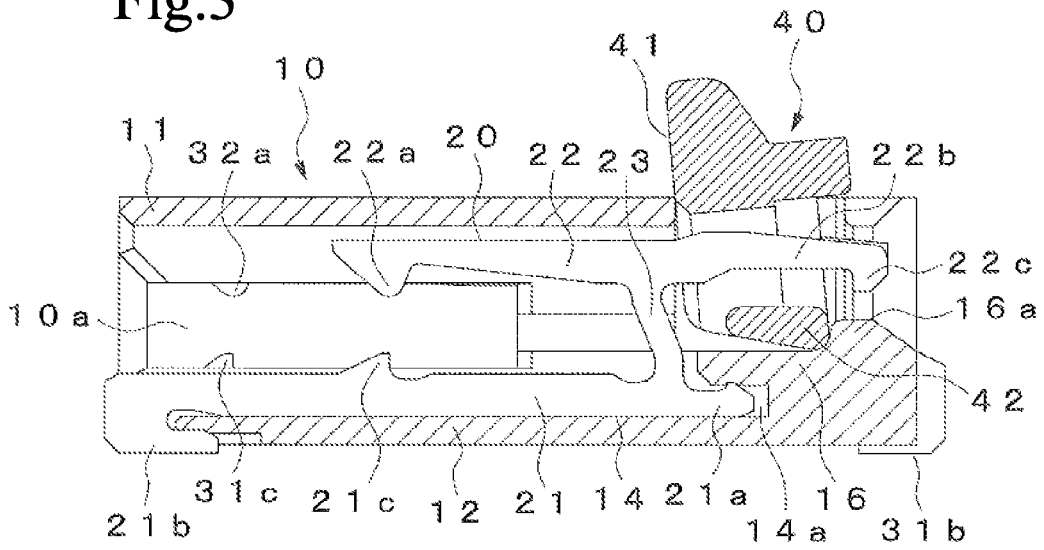
FIG. 3 is a side cross-sectional view of the connector.
Figure 4:
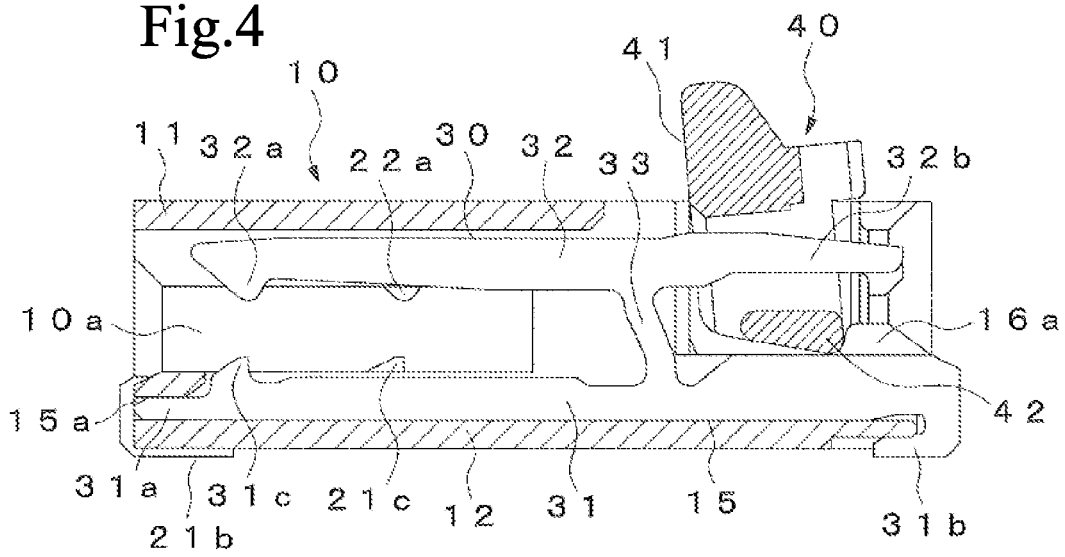
FIG. 4 is a side cross-sectional view of the connector.

FIGS. 1 to 11 illustrate an embodiment of the present invention, which is a connector for connecting, for example, an object to be inserted, such as a flexible printed circuit (FPC) or a flexible flat cable (FFC).

This connector includes a connector main body 10 to which a flexible circuit 1 or an object to be inserted is inserted from the front, a plurality of first terminals 20 and a plurality of second terminals 30 disposed in the connector main body 10 at certain intervals in the width direction, and a pressing member 40 that presses the first terminals 20 and the second terminals 30 against the flexible circuit 1 inserted in the connector main body 10. The first terminal 20 and the second terminals 30 are alternately arrayed in the width direction of the connector main body 10.

The flexible circuit 1 is a flat object to be inserted having flexibility in the thickness direction, such as a so-called flexible flat cable (FFC) or a flexible printed circuit (FPC). A plurality of electrical contacts (not shown) are provided on both surfaces in the thickness direction of the flexible circuit 1 at certain intervals in the width direction.

The connector main body 10 is a synthetic-resin molding, which has an insertion hole 10*a* into which the flexible circuit 1 is to be inserted. The connector main body 10 has an upper surface 11, a bottom surface 12, and side surfaces 13. The connector main body 10 accommodates a plurality of first terminal holes 14 that hold individual first terminals 20 and a plurality of second terminal holes 15 that hold individual second terminals 30 alternately in the width direction of the connector main body 10.

The individual first terminal holes 14 are formed on the bottom surface 12 of the connector main body 10 in such a manner that they extend in the front-to-back direction, into which the first terminals 20 are inserted from the front of the connector main body 10. In this case, holding holes 14*a* that hold the rear ends of the first terminals 20 are provided at the rear ends of the individual first terminal holes 14.

The individual second terminal hole 15 are formed on the bottom surface 12 of the connector main body 10 in such a manner that they extend in the front-to-back direction, into which the second terminals 30 are inserted from the back of the connector main body 10. In this case, holding holes 15*a* that hold the front ends of the second terminals 30 are provided at the rear ends of the individual second terminal holes 15.

The connector main body 10 has supporting portions 16 that rotatably support the pressing member 40 at the rear end. The supporting portions 16 are formed at the rear end of the bottom surface 12 to support the pressing member 40 with their upper surfaces. The supporting portions 16 each have, at the rear end, a retaining portion 16*a* that retains the pressing member 40 to restrict the backward movement of the pressing member 40. The retaining portion 16*a* is provided for each of the first terminals 20. The retaining portion 16*a* protrudes upwards from the upper surface of the supporting member 16. The front surface of the retaining portion 16*a* forms a curve that continues from the upper surface of the supporting portion 16. The retaining portion 16*a* is wider than the first terminal 20.

The first terminals 20 are each formed of an electrically conductive metal plate and are inserted in the individual first terminal holes 14 of the connector main body 10 from the front of the connector main body 10. The first terminals 20 each include a fixed piece 21 disposed on the bottom of the connector main body 10, a movable piece 22 disposed above the fixed piece 21, and an elastic piece 23 provided between the fixed piece 21 and the movable piece 22.

The fixed pieces 21 extend in the front-to-back direction of the connector main body 10, and the rear ends 21*a* thereof are press-fitted in the holding holes 14*a* of the first terminal holes 14. The fixed pieces 21 each have, at the front ends, a connecting portion 21*b* to be connected to a substrate (not shown). The connecting portions 21*b* are located at the bottom of the connector main body 10. The fixed pieces 21 each have, at substantially the center in the front-to-back direction, a first contact portion 21*c* that is to come into contact with an electrical contact on the lower surface of the flexible circuit 1 in such a manner as to protrude upwards.

The movable pieces 22 extend in the front-to-back direction of the connector main body 10. The movable pieces 22 each have, at the front ends, a second contact portion 22*a* that is to come into contact with an electrical contact on the upper surface of the flexible circuit 1 in such a manner as to protrude downwards. The movable pieces 22 each have, at the rear ends, a butted portion 22*b* that the pressing member 40 butts from below. The butted portion 22*b* is disposed with a certain distance in the vertical direction from the supporting portion 16 of the connector main body 10. The butted portion 22*b* has, at the rear ends, a protrusion 22*c* that protrudes downwards.

The elastic piece 23 extends in the vertical direction from the rear end of the fixed piece 21 to substantially the center of the movable piece 22. The movable piece 22 is displaced due to the electric deformation of the elastic piece 23.

The second terminals 30 are each formed of an electrically conductive metal plate and are inserted in the individual second terminal holes 15 of the connector main body 10 from the back of the connector main body 10. The second terminals 30 each include a fixed piece 31 disposed on the bottom of the connector main body 10, a movable piece 32 disposed above the fixed piece 31, and an elastic piece 33 provided between the fixed piece 31 and the movable piece 32.

The fixed pieces 31 extend in the front-to-back direction of the connector main body 10, and the front ends 31*a* thereof are press-fitted in the holding holes 15*a* of the second terminal holes 15. In this case, the upper ends of the fixed pieces 31 at the rear ends have the same height as that of the upper surfaces of the supporting portions 16 of the connector main body 10. The fixed pieces 31 each have, at the front ends, a connecting portion 31*b* to be connected to a substrate (not shown). The connecting portions 31*b* are located at the bottom of the connector main body 10. The fixed pieces 31 each have, at the front ends, a first contact portion 31*c* that is to come into contact with an electrical contact on the lower surface of the flexible circuit 1 in such a manner as to protrude upwards.

The movable piece 32 extends in the front-to-back direction of the connector main body 10 and has, at the front end, a second contact portion 32*a* that is to come into contact with an electrical contact on the upper surface of the flexible circuit 1 in such a manner as to protrude downward. In this case, the movable pieces 32 of the second terminals 30 are longer toward the front than the movable pieces 22 of the first terminals 20, so that the second contact portions 32*a* of the second terminals 30 are located nearer to the front than the second contact portions 22*a* of the first terminals 20. The movable pieces 32 each have, at the rear ends, a butted portion 32*b* that the pressing member 40 butts from below. The butted portion 32*b* is disposed with a certain distance in the vertical direction from the rear end of the fixed piece 31.

The elastic piece 33 extends in the vertical direction from substantially the center in the front-to-back direction of the fixed piece 31 to substantially the center in the front-to-back direction of the movable piece 32. The movable piece 32 is displaced due to the elastic deformation of the elastic piece 33.

The pressing member 40 is a synthetic-resin molding, which extends in the width direction of the connector main body 10 and is disposed at the rear end of the connector main body 10. The pressing member 40 includes an operating portion 41 protruding outwards from the connector main body 10 and a pressing portion 42 that pushes up the rear ends of the movable pieces 22 and 32 of the first and second terminals 20 and 30. The pressing portion 42 is located between the butted portions 22*b* and 32*b* of the movable pieces 22 and 32 and the supporting portions 16 of the connector main body 10.

Figure 5:
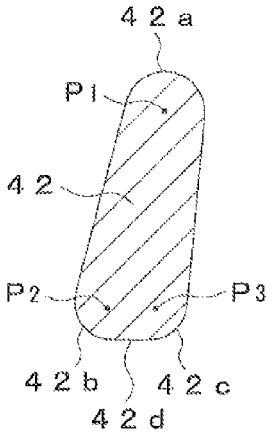
FIG. 5 is a side cross-sectional view of a pressing portion.
Figure 6:
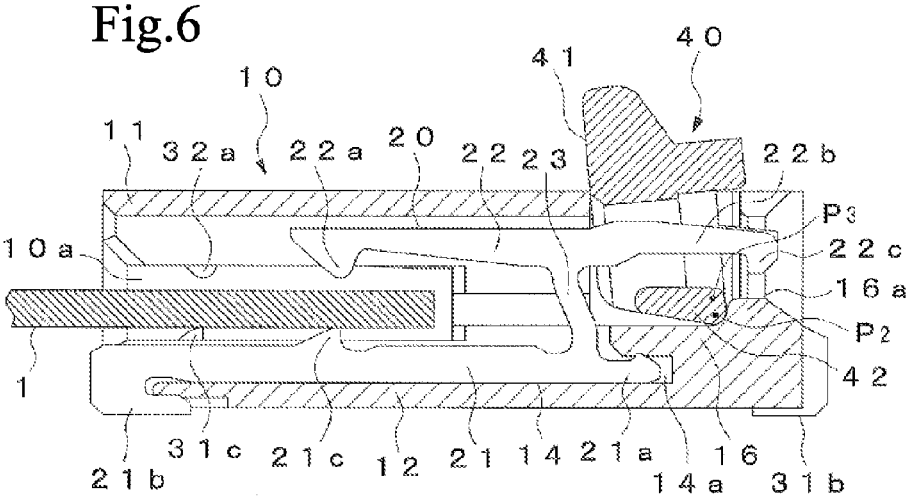
FIG. 6 is a side cross-sectional view of the connector, illustrating the operation of a first terminal and the pressing member.
Figure 8:
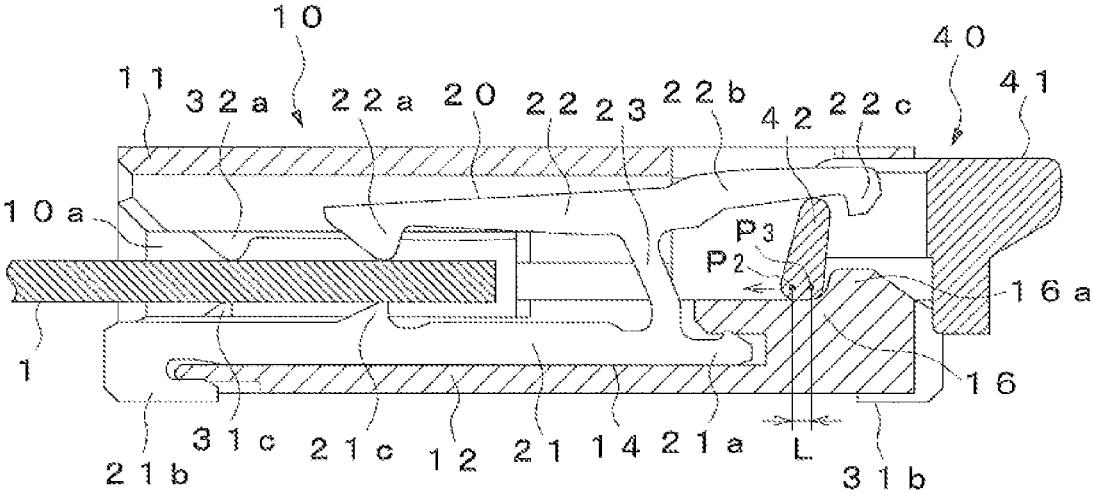
FIG. 8 is a side cross-sectional view of the connector, illustrating the operation of the first terminal and the pressing member.
Figure 9:
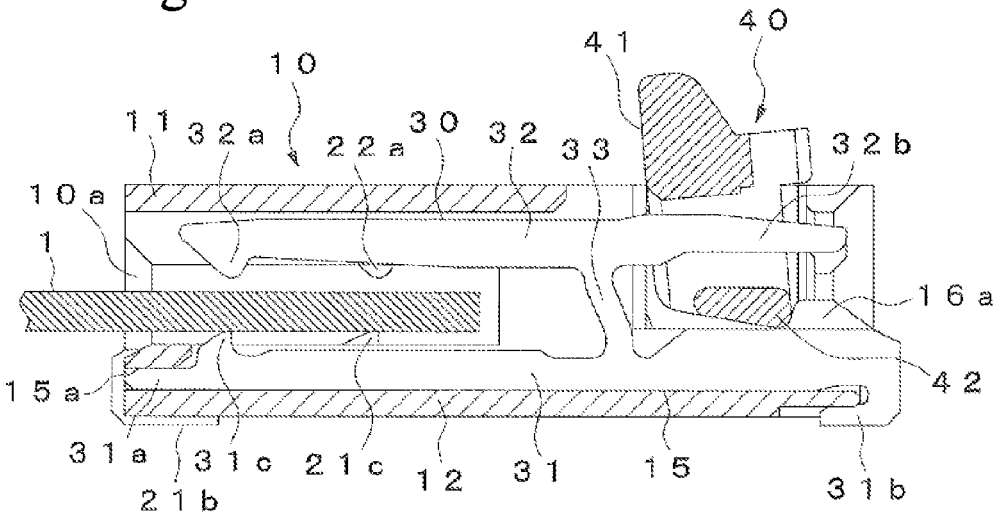
FIG. 9 is a side cross-sectional view of the connector, illustrating the operation of a second terminal and the pressing member.
Figure 11:
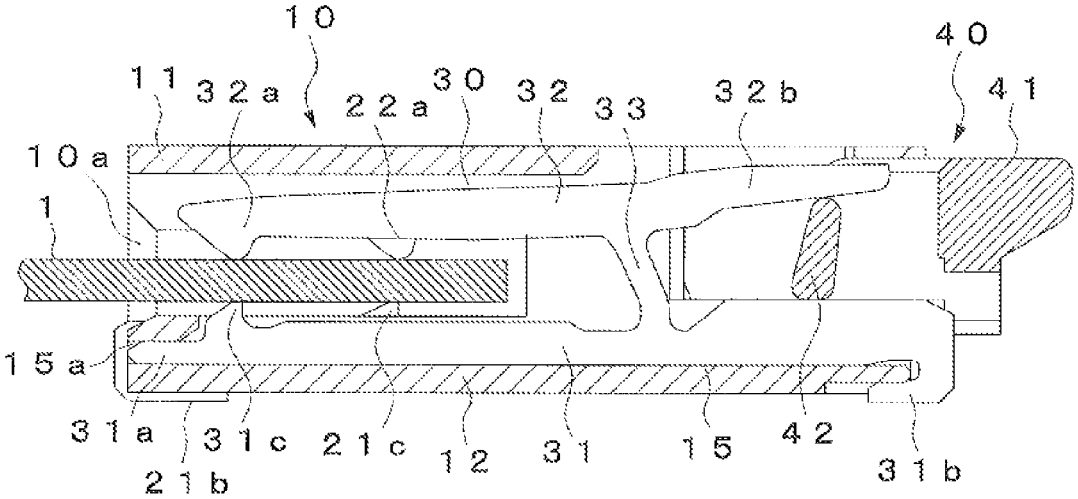
FIG. 11 is a side cross-sectional view of the connector, illustrating the operation of the second terminal and the pressing member.

The pressing portion 42 has a substantially elliptical cross section. As shown in FIGS. 6 and 9, at a rotated position at which the operating portion 41 is located above, the longitudinal direction in cross section of the pressing portion 42 is in the front-to-back direction, and as shown in FIGS. 8 and 11, at a rotated position in which the operating portion 41 is located at the back, the longitudinal direction in cross section of the pressing portion 42 is in the vertical direction. The pressing portion 42 is formed such that the width in the front-to-back direction is larger at a first end in the longitudinal direction in cross section (the lower end at the rotated position in FIGS. 6 and 9) than at a second end in the longitudinal direction in cross section (the upper end at the rotated position in FIGS. 6 and 9). In this case, as shown in FIG. 5, the circumferential surface of the pressing portion 42 at the second end in the longitudinal direction in cross section is formed of a first arc-shaped curved portion 42*a* centered at a point P1. The circumferential surface of the pressing portion 42 at the first end in the longitudinal direction in cross section is formed of a second arc-shaped curved portion 42*b* centered at a point P2, a third arc-shaped curved portion 42*c* centered at a point P3, and a planar portion 42*d* connecting the second curved portion 42*b* and the third curved portion 43*b*.

Figure 7:
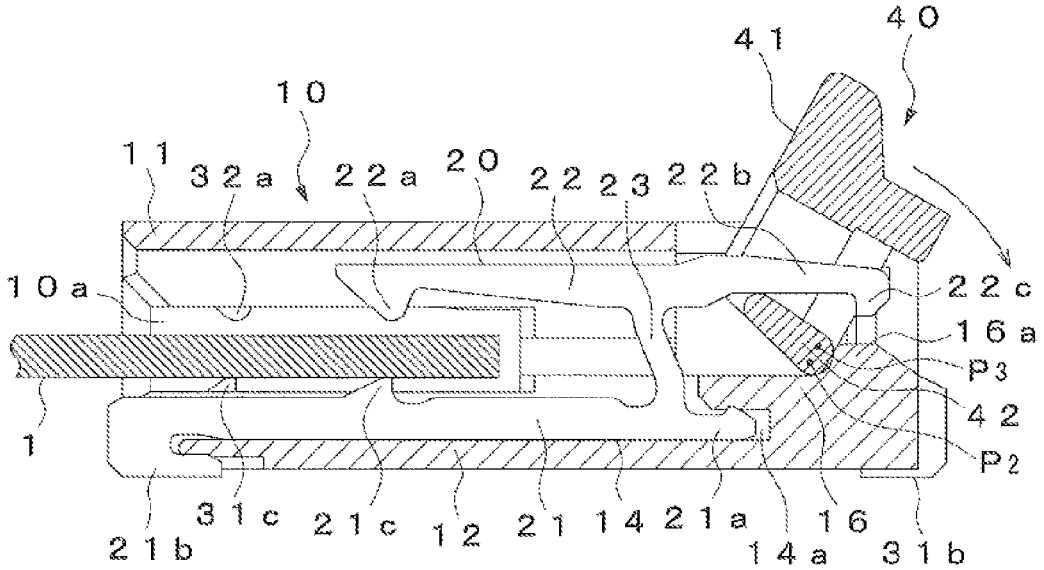
FIG. 7 is a side cross-sectional view of the connector, illustrating the operation of the first terminal and the pressing member.
Figure 10:
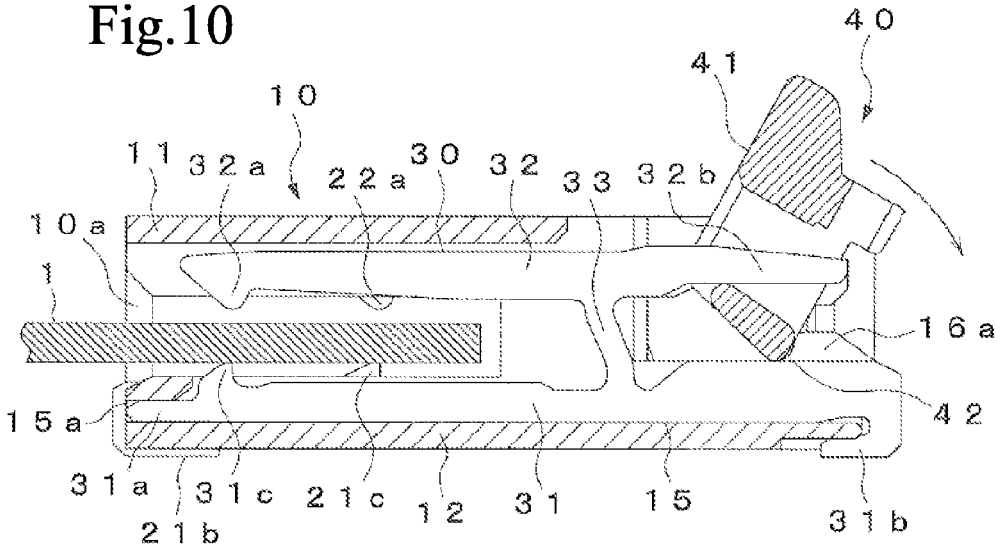
FIG. 10 is a side cross-sectional view of the connector, illustrating the operation of the second terminal and the pressing member.

When the flexible circuit 1 is to be connected to the thus-configured connector, first, as shown in FIGS. 6 and 9, the flexible circuit 1 is inserted into the connector main body 10 through the insertion hole 10*a* in a state in which the pressing member 40 is at the rotated position at which the operating portion 41 is located above the connector main body 10. Next, as shown in FIGS. 7 and 10, the pressing member 40 is rotated backwards while the operating portion 41 is being pushed backwards. This causes the pressing portion 42 of the pressing member 40 to rotate between the butted portions 22*b* and 32*b* of the movable pieces 22 and 32 of the first and second terminals 20 and 30 and the supporting portions 16 of the connector main body 10, causing the second end of the pressing portion 42 in the longitudinal direction in cross section to butt the butted portions 22*b* and 32*b* of the movable pieces 22 and 32 while the first end of the pressing portion 42 in the longitudinal direction in cross section is butting the supporting portions 16 of the connector main body 10. Thereafter, as shown in FIGS. 8 and 11, the operating portion 41 rotates the pressing member 40 to a rotated position at the back of the connector main body 10. This causes the rear ends (butted portions 22*b* and 32*b*) of the movable pieces 22 and 32 to be pushed up by the pressing portion 42, causing the front ends of the movable pieces 22 and 32 to be displaced downwards due to the elastic deformation of the elastic pieces 23 and 33, thereby bringing the second contact portions 22*a* and 32*a* of the movable pieces 22 and 32 downwards into pressure-contact with the upper surface of the flexible circuit 1.

Thus, the second contact portions 22*a* and 32*a* of the movable pieces 22 and 32 come into contact with electrical contacts on the upper surface of the flexible circuit 1, and the first contact portions 21*c* and 31*c* of the fixed pieces 21 and 31 come into contact with electrical contacts on the lower surface of the flexible circuit 1, and thus, the flexible circuit 1 is connected to the first and second terminals 20 and 30.

Since the first end of the pressing portion 42 in the longitudinal direction in cross section rotates while being retained by the retaining portions 16*a* of the supporting portions 16 in the rotation of the pressing member 40, the backward movement of the pressing portion 42 is restricted by the retaining portions 16*a*. During the early stage of the rotation, the pressing portion 42 rotates about the point P2, as shown in FIG. 6, though, the rotation center moves gradually from the point P2 to the point P3, as shown in FIG. 7, and at the end of the rotation, the pressing portion 42 rotates about the point P3, as shown in FIG. 8. Thus, at the end of the rotation, the pressing portion 42 moves forwards by the distance L between the point P2 and the point P3 while the first end in the longitudinal direction in cross section is retained by the retaining portions 16*a*. Accordingly, since the rotation of the pressing portion 42 involves the forward movement of the first end of the pressing portion 42 in the longitudinal direction in cross section, the force of the pressing portion 42 to climb over the retaining portions 16*a* is suppressed as compared with that only with the rotation, and hence, the pressing portion 42 does not easily come off backwards.

As described above, the connector of this embodiment has, at the rear end of the connector main body 10, the supporting portions 16 that rotatably support the pressing portion 42. Since the pressing portion 42 rotates while butting the rear ends of the movable pieces 22 and 32 and the supporting portions 16 of the connector main body 10, the rear ends of the movable pieces 22 and 32 are pushed up by the pressing portion 42. Thus, the butting of the pressing portion 42 and the supporting portions 16 is contact between synthetic-resin components. This eliminates the pressing portion 42 being cut off due to contact with the supporting portions 16 even if the rotation of the pressing member 40 is repeated, thereby preventing the shape degradation of the pressing portion 42. This allows the movable pieces 22 and 32 pushed up by the pressing portion 42 to be constantly kept at a sufficient height, thus effectively preventing a decrease in the contact pressure of the movable pieces 22 and 32 on the flexible circuit 1.

Furthermore, the backward movement of the pressing portion 42 is restricted by retaining the pressing portion 42 with the retaining portions 16*a* of the supporting portions 16. This can prevent the pressing portion 42 from coming off backwards with the retaining portions 16*a*.

In this case, the pressing portion 42 is formed to move forwards while being retained by the retaining portions 16*a* while rotating in the direction in which the pressing portion 42 pushes up the movable pieces 22 and 32. Accordingly, since the rotation of the pressing portion 42 involves forward movement, the force of the pressing portion 42 to climb over the retaining portions 16*a* is suppressed as compared with that only with the rotation, and thus, it is remarkably advantageous in preventing the pressing portion 42 from coming off backwards.

Since the supporting portions 16 are wider than the first terminals 20, the contact area between the supporting portions 16 and the pressing portion 42 can be large, which is remarkably advantageous in preventing the pressing portion 42 from being cut off.

Furthermore, the first terminals 20 inserted into the connector main body 10 from the front and the second terminals 30 inserted into the connector main body 10 from the back are alternately arrayed in the width direction of the connector main body 10. The connector main body 10 is provided with the plurality of first terminal holes 14 that hold the individual first terminals 20, the plurality of second terminal holes 15 that hold the individual second terminals 30, and the supporting portions 16 at the back of the individual first terminal holes 14. Thus, the first terminal holes 14 do not extend to the rear end of the connector main body 10; instead, the supporting portions 16 can be formed at the rear end of the connector main body 10. This allows the first terminal holes 14 not to be present below the supporting portions 16, thus providing an enough portion for the supporting portions 16 at the rear end of the connector main body 10.

In the above embodiment, the first terminals 20 inserted into the connector main body 10 from the front and the second terminals 30 inserted into the connector main body 10 from the back are alternately arrayed in the width direction of the connector main body 10. In another embodiment, for example, only the first terminals 20 may be provided.

REFERENCE SIGNS LIST

1 flexible circuit
10 connector main body
14 first terminal hole
15 second terminal hole
16 supporting portion
16*a* retaining portion
20 first terminal
30 second terminal
40 pressing member
42 pressing portion

The invention claimed is:

1. A connector comprising:

a synthetic-resin connector main body into which an object to be inserted is to be inserted from the front;

a plurality of terminals held in the connector main body at certain intervals in a width direction;

movable pieces provided at the individual terminals in such a manner as to extend in a front-to-back direction; and a synthetic-resin pressing member rotatably provided at a rear end of the connector main body, the pressing member bringing the movable pieces of the individual terminals into pressure-contact with the object by rotating in a predetermined direction, wherein when the pressing member is rotated in the predetermined direction, a pressing portion provided at the pressing member pushes up the rear ends of the movable pieces of the individual terminals while rotating to displace the front ends of the movable pieces downwards into contact with the upper surface of the object, wherein the connector main body has, at the rear end, supporting portions that rotatably support the pressing portion; and the pressing portion rotates while butting the rear ends of the movable pieces and the supporting portions of the connector main body so that the rear ends of the movable pieces are pushed up by the pressing portion;

the supporting portions each includes a retaining portion that retains the pressing portion to restrict the backward movement of the pressing portions; and the pressing portion is configured to move forwards while being retained by the retaining portion when rotated in the predetermined direction.

2. The connector according to claim 1, wherein the retaining portion is larger in width than the terminal.

3. The connector according to claim 1, wherein the terminals include a plurality of first terminals inserted into the connector main body from the front so as to be held in the connector main body and a plurality of second terminals inserted into the connector main body from the back so as to be held in the connector main body;

the first terminals and the second terminals are alternately arrayed in the width direction of the connector main body; and the connector main body includes a plurality of first terminal holes that hold the individual first terminals and a plurality of second terminal holes that hold the individual second terminals, and the supporting portions are provided at the back of the individual first terminal holes.

4. The connector according to claim 2 wherein the terminals include a plurality of first terminals inserted into the connector main body from the front so as to be held in the connector main body and a plurality of second terminals inserted into the connector main body from the back so as to be held in the connector main body;

the first terminals and the second terminals are alternately arrayed in the width direction of the connector main body; and the connector main body includes a plurality of first terminal holes that hold the individual first terminals and a plurality of second terminal holes that hold the individual second terminals, and the supporting portions are provided at the back of the individual first terminal holes.

* * * * *